United States Patent [19]

Sterling et al.

[11] Patent Number: 5,054,163

[45] Date of Patent: Oct. 8, 1991

[54] BOTTOM PIVOT ASSEMBLY FOR FOLDING DOORS

[75] Inventors: John R. Sterling, Wonder Lake, Ill.; Richard G. Kluge, Pell Lake, Wis.

[73] Assignee: John Sterling Corporation, Richmond, Ill.

[21] Appl. No.: 638,364

[22] Filed: Jan. 4, 1991

[51] Int. Cl.[5] ..... E05D 7/04; E05D 7/08; E05D 15/26

[52] U.S. Cl. ..... 16/244; 16/248; 16/378; 411/435

[58] Field of Search ..... 16/238, 243, 244, 245, 16/248, 249, 378, 379; 160/199, 206; 411/435

[56] References Cited

U.S. PATENT DOCUMENTS

| | | | |
|---|---|---|---|
| 3,335,785 | 8/1967 | Anderson et al. | 16/378 |
| 3,358,545 | 12/1967 | Williams | 411/435 |
| 3,592,257 | 7/1971 | Matyas | 16/244 |
| 3,805,324 | 4/1974 | Johnson | 16/244 |
| 3,866,658 | 2/1975 | Smith | 16/249 |

FOREIGN PATENT DOCUMENTS

| | | | |
|---|---|---|---|
| 877607 | 8/1971 | Canada | 16/244 |
| 2125626 | 12/1972 | Fed. Rep. of Germany | 160/206 |
| 1151127 | 5/1969 | United Kingdom | 411/435 |

*Primary Examiner*—Robert L. Spruill
*Attorney, Agent, or Firm*—McCaleb, Lucas & Brugman

[57] ABSTRACT

A four piece bottom pivot assembly for undersupporting the lower end of a pivotally mounted door panel in a bi-fold door assembly in which a bottom pivot pin is non-rotatably locked into a tubular sleeve extending into a socket formed in the bottom end of the door panel. The pivot pin is formed with a threaded shank having a guide portion at its upper end which slidingly cooperates with guideways in the sleeve to prevent rotation of the pivot pin. An adjustment wheel is threaded onto the threaded shank of the pivot pin and is rotatably coupled to the bottom end of the sleeve such that rotation of the wheel threadingly actuates the pivot pin coaxially of the sleeve to adjust door height. A detent system removably holds the wheel in selected rotational positions. The pivot pin is formed with a shoulder adjacent its cylindrical outer end which limits insertion of such outer end through an elongated slot having serrated edges formed in an underlying arm of a floor engaging pivot bracket; the pivot pin engaging and being held between adjacent serrated edges of the pivot bracket slot to align the door panel's vertical pivot axis.

4 Claims, 2 Drawing Sheets

BOTTOM PIVOT ASSEMBLY FOR FOLDING DOORS

This invention relates generally to folding door hardware and more particularly to improvements in bottom pivot assemblies for use with pivotally supported door panels.

BACKGROUND OF THE INVENTION

In a typical bi-folding door installation to which the present invention pertains, one or more folding door panels are mounted for movement about a vertical pivot axis located adjacent a lateral jamb member of a door frame. The pivot axis is defined by top and bottom pivot pins projecting from respective to and bottom edges of the panel to engage adjacent pivot brackets. The top pivot bracket is generally secured in a downwardly open guide track and the bottom bracket is normally secured to an adjacent jamb member of the door frame and/or to an underlying support. Such pivot assemblies are designed to adjust the vertical alignment of the door panel's pivot axis as well as the vertical position of the panel within the door frame opening. These adjustments generally are accomplished by laterally adjusting the position of the bottom pivot relative to the door frame and by extending or retracting the pivot pin to vertically raise or lower the door panel.

While a wide variety of such bottom pivot assemblies have been developed, that described in U.S. Pat. No. 4,106,158 issued Aug. 15, 1978, generally exemplifies the present state of the art with respect to commercially available low cost pivot assemblies.

As taught in that patent, a bottom pivot pin having a cylindrical shank is threaded into an internally threaded sleeve mounted in the bottom end of a pivotally suspended door panel. Threaded adjustment of the pivot pin in the sleeve determines the vertical position of the door panel in the door frame. The lower end of the pivot pin is formed by an externally splined conical head portion adapted to non-rotatably engage serrations formed along opposite edges of an elongated slot formed in a floor engaging bottom jamb bracket. Raising the door vertically serves to disengage the conical head of the pivot pin from the serrations whereby lateral repositioning of the pin along the bracket's slotted opening may take place to adjust vertical alignment of the door's pivot axis while threaded adjustment of the pin adjusts the door's vertical position.

While the simplicity of this structure has met with general commercial acceptance, in operation the conical head of the pivot pin has a tendency to disengage from the serrations of the bottom jamb bracket slot under sometimes relatively violent or jarring impact forces accompanying door opening and closing movements. This tendency permits the door's pivot axis to shift laterally and at times to effect rotational threading movement of the pin relative to the door mounted sleeve thereby to alter the vertical adjusted position of the door panel. Such tendency toward loss or change in door adjustment has created a demand for a bottom pivot assembly having a more positive and secure pivot adjustment system capable of maintaining door alignment. It is to just such an improved pivot assembly that the present invention is directed.

SUMMARY OF THE INVENTION

A bottom pivot assembly for pivotally undersupporting a door panel in a bi-folding door installation in which a bottom pivot is non-rotatably held for sliding movement within a tubular sleeve socket frictionally locked or embedded against rotation in a cylindrical socket formed inwardly of the bottom edge of the door panel. The pivot pin has a threaded shank portion which is formed to slidably interfit with the sleeve and is threadingly engaged with an adjustment wheel that is rotatably coupled to the lower end of the stationary sleeve and which acts to limit axial movement of the pin in the sleeve [whereby to adjust the door panel's vertical position.] The bottom or lower end of the pivot pin is formed with a cylindrical axial extension beneath a transverse stop shoulder adapted to engage the upper surface of a floor mounted pivot bracket. Such bracket has a horizontal extending arm formed with a raised platform that is distinguished by an elongated slot formed by a series of alternately overlapping cylindrical openings defining serrated edges along the length of the slot for rotatably receiving the lower end of the pivot pin. Placement of the pivot pin's lower end in a selected opening serves to laterally locate the vertical pivot axis of the door panel.

It is a principle object of this invention to provide a new, improved and simplified structure for a bottom pivot assembly useful with pivotally supported panels.

Another important object of this invention is to provide a simplified four piece structure for a bottom pivot assembly used in folding door installations which is characterized by positive and secure adjustment means for aligning the door panel's pivot axis and the vertical positioning of the door panel within a door frame opening.

Still another important object of this invention is to provide a new and improved bottom pivot assembly for undersupporting a pivotally suspended door panel and the like which is characterized by a pivot pin that is rotatably moveable with the door and which includes positive acting, simplified adjustment means for regulating the vertical position of the door panel relative to an underlying support bracket.

Having described this invention the above and further objects, features and advantages thereof will become apparent to those familiar with the art from the following detailed description of a preferred embodiment of the invention illustrated in the accompanying drawings and representing the best mode presently contemplated for enabling those of skill in the art to practice this invention.

IN THE DRAWINGS

DESCRIPTION OF THE PREFERRED EMBODIMENT

Figure 1:
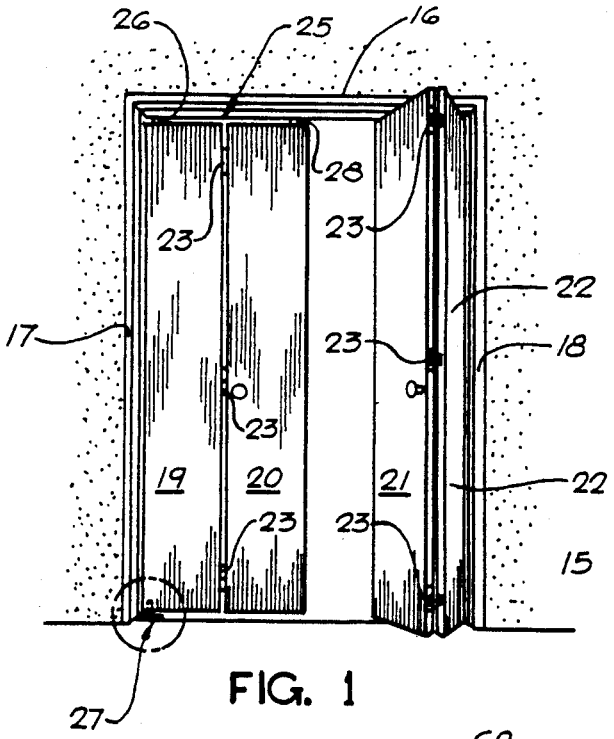
FIG. 1 is a front perspective of a bi-fold door installation incorporating the bottom pivot assembly of this invention.

Referring initially to FIG. 1 of the drawings it will be understood that the present invention concerns bi-folding door installations. As therein depicted a wall 15 is provided with a doorway opening bounded by a horizontal header 16 and parallel side jamb members 17 and 18 with a floor or other undersupport defining the fourth side of the doorway opening. Within the doorway are four folding panels 19, 20, 21 and 22 arranged in cooperating pairs with panels 19 and 20 being interjoined at adjacent vertical edges thereof by hinge means 23. The other pair of panels 21 and 22 are similarly interjoined by hinge means 23. The two pairs of hingedly interjoined panels are identical with one being a mirror reflection of the other. Each panel pair is adapted to move about a vertical axis adjacent a respective adjacent side jamb member 17 or 18.

Extending over the top of the panels is a track 25 attached to header 16. Adjacent jamb member 17 and anchored in track 25 is a top pivot assembly 26 which cooperates with a bottom pivot assembly 27 of this invention which preferably is secured to jamb member 17 and the underlying floor support. At the upper right hand end of the panel 20 is a guide roller assembly 28 which engages the header track 25 and serves to guide the non-hinged edge of the panel 20 along the header track 25 in response to folding movement of the two panels 19 and 20 during the opening an closing operation thereof. The other panels 21 and 22 are mounted in an identical manner and will not be described further hereat.

Both the top and bottom pivot assemblies are secured to their respective panel 19 or 22, as the case may be, by vertical socket openings formed in the top and bottom edges of such panels and into which appropriate tubular mounting sleeves are inserted.

Figure 2:
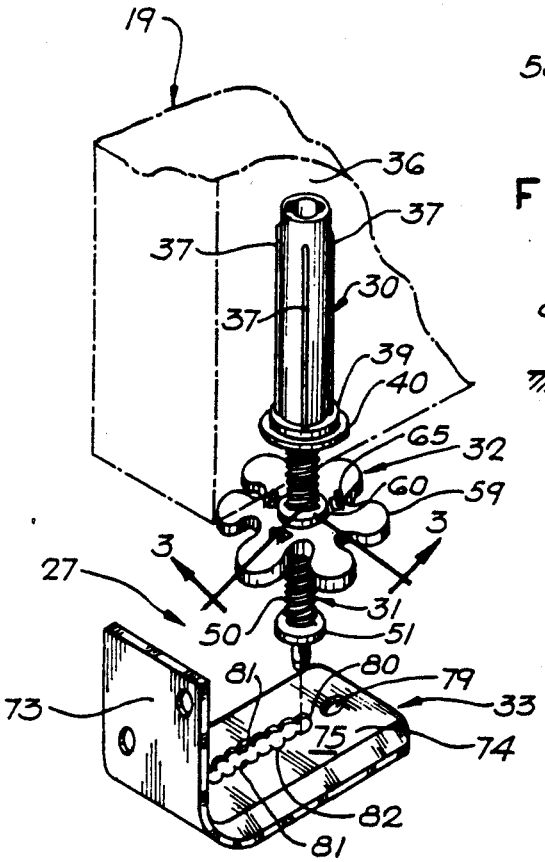
FIG. 2 is a partially exploded perspective of the four piece bottom pivot assembly of this invention.

With specific reference to FIG. 2 of the drawings, the bottom pivot assembly 27 (encircled in FIG. 1) will be recognized as comprising a four part assembly of a tubular mounting sleeve 30, a solid metal pivot pin 31, an adjustment wheel 32 and a rigid pivot bracket 33, according to this invention.

Figures 8, 9:
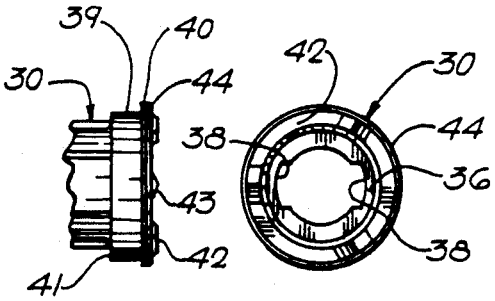
FIG. 8 is a bottom plan view of the sleeve shown in FIG. 7.
FIG. 9 is a partial side elevation of the bottom end of the sleeve to illustrate the detent projections thereon.

With reference to FIGS. 2, 5 and 7–9 of the drawings, the features of the mounting sleeve 30 will now be set forth. As there shown, sleeve 30 comprises a generally cylindrical, tubular body 36 having radially extending elongated ribs 37 circumferentially spaced about its exterior and which operate, when the tubular body 36 is inserted into a mounting socket (unnumbered) formed inwardly of the bottom edge of the door panel 19, to penetrate the sides of such socket and lock the body 36 against rotational movement. The hollow interior of body 36 as best shown in FIGS. 2 and 8 of the drawings is distinguished by cylindrical axial chamber having a pair of diametrically opposed elongated channel guideways 38, 38 extending along opposite sides of the body's axial chamber. Such channels 38 serve as guideways for sliding cooperation with the pivot pin 31 as will appear more fully hereinafter.

Figure 5:
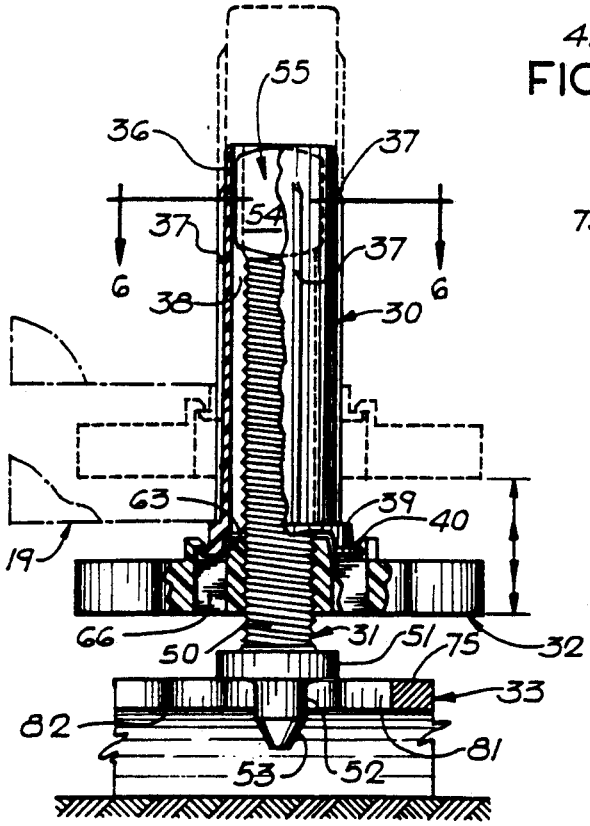
FIG. 5 is a view in side elevation of the bottom pivot assembly hereof with portions broken away in section to illustrate the assembled relationship of parts.
Figure 10:
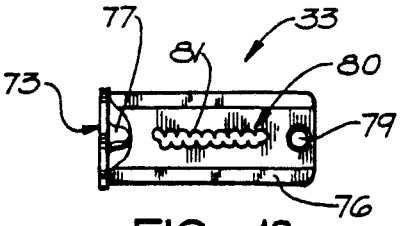
FIG. 10 is a top plan view of the floor engaging bottom pivot bracket shown in FIG. 2.
Figure 11:
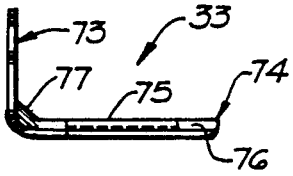
FIG. 11 is a side elevation of the bracket shown in FIG. 10.
Figure 12:
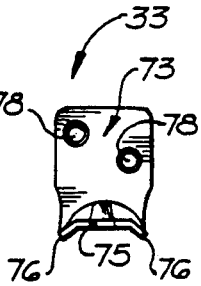
FIG. 12 is an end elevation thereof looking from the right hand end of the bracket as oriented in FIGS. 10 and 11.

At the lower end of the body 36 a circumferential and radially outwardly extending cylindrical stop shoulder 39 is formed which extends outwardly beyond the exterior limits of the body 36 and ribs 37 as shown best in FIGS. 2 and 5. Shoulder 39 serves to underengage the bottom edge of the door panel 19 when sleeve 30 is inserted into the mounting socket therefore so as to limit insertion of the body 36 into the door panel and accurately position the lowermost end of the mounted sleeve spaced beneath the bottom edge of the door panel. As noted in particular in FIGS. 2 and 5, the lower end of the mounting sleeve 30 is distinguished by a an annular lip flange 40 located immediately adjacent and beneath stop shoulder 39 and extending radially outwardly of the latter for reasons which will appear presently. Preferably the mounting sleeve 30 is formed as a unitary molding of tough rigid plastic, such as nylon, so that the various described portions thereof are integral.

Figure 7:
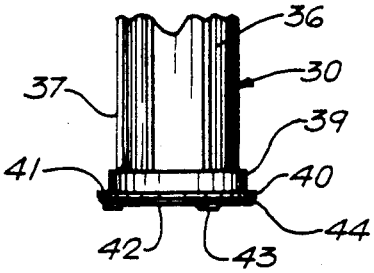
FIG. 7 is a partial foreshortened side elevation of the lower end of the pivot mounting sleeve.

It will be noted from FIGS. 7, 8 and 9 that while the upper face of the lip flange 40 is planar, the lower face 42 thereof is distinguished by three circumferentially spaced, axially outwardly extending male detents 43 located at substantially 120° intervals (see FIG. 8). Further, it will be observed that face 42 is angularly chamfered at its outer edge, as indicated at 44, to eliminate a sharp corner or edge thereon whereby to avoid interference with rotation of the adjustment wheel 32, as will be described in greater detail hereinafter.

With reference to FIGS. 2, 3, 5 and 6 of the drawings, the bottom pivot 31 comprises an exteriorly threaded rigid and generally cylindrical solid body portion 50 formed to include an integral stop collar 51 of generally cylindrical or annular formation located adjacent the lower end of threaded body 50 and extending radially outwardly therefrom. The operationally lower end of the pivot is further formed with a cylindrical axially projecting stem portion 52 of reduced diameter having a frustro-conical or semi-pointed terminal end 53 for assisting engagement thereof with the underlying bracket 33, as will be described in greater detail hereinafter.

Figure 6:
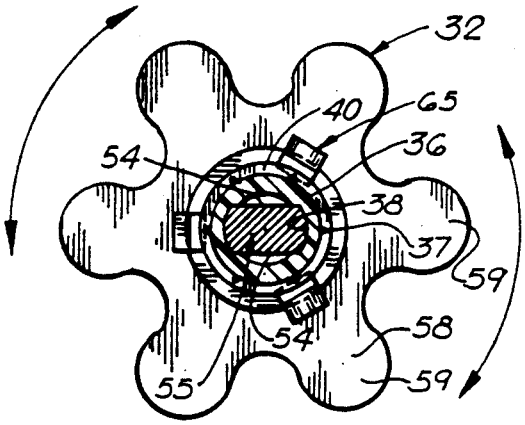
FIG. 6 is a partial top plan view of the assembly seen in FIG. 5 taken substantially along vantage line 6—6 of FIG. 5 and looking in the direction of the arrows thereon.

The operationally upper end of pivot 31 is distinguished by a pair of parallel spaced planar surfaces or flats 54, 54 formed by upsetting the upper end of the pivot's threaded body portion to provide guide means, indicated generally at 55, which is of substantially rectangular cross section extending radially outwardly of body portion 50 as shown in FIG. 6 of the drawings. Such guide portion 55 is dimensioned to fit loosely within the opposing guide channels 38 of the mounting sleeve whereby the pivot pin is non-rotatably secured to sleeve 30, but is adapted for sliding axial movement relative thereto in response to threading movement of the adjustment wheel about the threaded body portion 50.

The features of adjustment wheel 32 will best be recognized from FIGS. 2–6 of the drawings. Wheel 32 preferably is molded of a suitable hard and durable plastic to comprise a substantially planar body 58 distinguished by a plurality of radially extending, manually engageable spokes 59, 59 (see FIG. 6). Formed centrally of the body 58 and integral with spokes 59 is a generally hollow cylindrical hub portion 60 having internal thread 61 adapted to engage the threaded body 50 of the pivot 31. It will be noted in FIG. 4 that hub portion 60 extends above the upper face 62 of body portion 58 of the adjustment wheel and has an outside diameter adapted to loosely interfit with the interior of the stop collar portion 39 at the lower end of the mounting sleeve as best illustrated in FIG. 5. In this particular illustrated instance, the exterior surface of portion 60 and the interior surface 63 of the stop collar 39 are frustro-conical in form. Thus the hub portion 60 fits within the lower end of the mounting sleeve to permit free rotational movement of the adjustment wheel relative to the mounting sleeve with the hub portion 60 and the interior surface 63 of the adjustment sleeve acting as bearing surfaces (see FIG. 5).

In order to rotatably interlock sleeve 30 and the adjustment wheel 32, the latter is formed with a plurality, in this case three, locking fingers 65 formed integrally with body 58 during the molding formation thereof by upsetting a portion of the molding material outwardly of face 62 of body 58 and forming generally rectangular openings 66 extending through the thickness of the body 58 immediately adjacent and radially outwardly of the hub portion 60. It will be noted that in the particular illustrated instance three locking fingers are provided at 120° intervals about the exterior of the hub 60. Each finger 65 comprises an upstanding neck portion 67 and a right angularly disposed arm portion 68 at the upper or outer end of neck portion 67 extending toward hub 60. The uppermost corner of each finger portion 68 is chamfered as indicated at 69.

It should be noted that the formation of the locking fingers 65 is such as to permit the neck portions thereof to slightly flex whereby the wheel 32 is assembled with the mounting sleeve 30 by forcing the lip flange 40 over the chamfered edges 69 and downwardly past the extending fingers 68 of the locking fingers so that they snap over flange 40 to rotatably interlocked in the manner shown in the assembly drawing FIG. 5. With this arrangement rotational movement of the wheel causes the threaded shank or body of the pivot 31 to move axially within the mounting sleeve whereby to adjust the protrusion of the pivot 31 relative to the lower edge of the door panel 19 in which the sleeve 30 is mounted.

It is to be noted that in the assembly of the sleeve 30 with the pivot pin 31 and adjustment wheel 32, the guide portion 55 at the upper end of the pivot 30 is formed after the adjustment wheel 32 is mounted over the threads of body 50 following which the sleeve 30 is fitted over the upper end of the pivot so that the guide means 55 are aligned to slide along the interior guide channels 38 of the sleeve. Once the sleeve is so mounted over the upper end of the pivot, the lip flange 40 thereof may be forced past the flexible locking fingers, as previously noted, to rotatably interlock the adjustment wheel 32 with the mounting sleeve 30. With this arrangement, once the sleeve 30 is inserted into a bore formed in the lower end of the door panel and non-rotatably secured therein by the rib means 37, rotational movement of the adjustment wheel 32 serves to threadingly translate the pivot pin relative to the bottom edge of the door. This provides vertical adjustment movement of the door panel relative to the pivot pin as indicated by the dotted lines showing set out in FIG. 5 of the drawings.

It will be recalled from the description set out hereinabove that the bottom end of the mounting sleeve 30 is provided with a plurality of detents 43 which, in the particular illustrated instance, are generally chisel shaped projections that project axially outwardly of the bottom face of the lip flange 40. As a consequence, when the mounting sleeve 30 is secured to the adjusting wheel 32 described above, lip 40 of the sleeve is captured beneath the locking fingers 65 and detents 43 ride on surface 62 of the adjusting wheel. The detents enter the openings 66 whenever the adjusting wheel is indexed to bring openings 66 opposite detents 43. In this latter respect it will be recalled that in the particular illustrated embodiment there are three such detent projections 43 and three openings 66 in the adjusting wheel spaced at 120° intervals. As a result of this arrangement with the weight of a door panel 19 transmitted to the mounting sleeve 30 and the pivot pin 31 engaged with the underdisposed floor bracket 33, vertical adjustment of the pivot pin via rotation of the adjusting wheel will cause the detents 43 to positively enter the openings 66 upon each one third rotational movement (i.e., 120°) of the adjustment wheel, whereby to removeably lock the wheel in desired adjusted position. The wheel, of course, can be rotated further than one third turn at a time by overriding the detents system as desired.

Turning now to FIGS. 2 and 10–12 of the drawings the features of floor bracket 33 will be described.

As shown, bracket 33 comprises an L-shaped metal stamping having a operationally vertical planar mounting arm 73 integral with a horizontally extending adjustment arm 74 distinguished by a central raised platform portion 75 flanked by longitudinally extending floor engaging and angularly disposed legs 76, 76. A reinforcing brace portion 77 extends angularly across the junction between platform portion 75 and the vertically disposed mounting arm 73. The mounting arm 73 is provided with a pair of spaced fastener receptive openings 78 and platform portion 75 preferably is provided with a fastener opening 79 whereby bracket 33 may be secured by screws or like fasteners to an adjacent side jamb member of the doorway frame, as well as the underlying floor.

Figure 3:
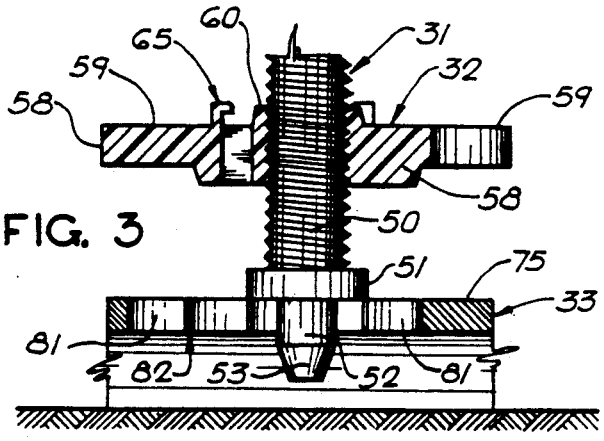
FIG. 3 is a partial enlarged view with portions in section, illustrating the interengaged condition of the pivot pin and bottom pivot bracket, with the adjustment wheel shown in section taken substantially along vantage line 3—3 of FIG. 2 and looking in the direction of the arrows thereon.
Figure 4:
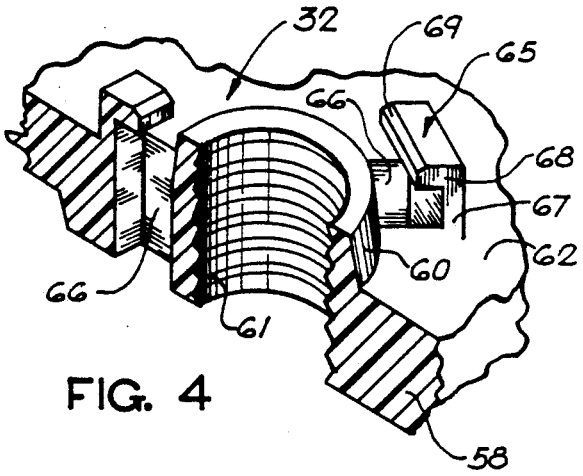
FIG. 4 is an enlarged partial perspective of adjustment wheel to illustrate the means for interconnecting the wheel to the pivot mounting sleeve.

The raised platform portion 75 is further distinguished by a centrally extending elongated slotted opening 80 having by a plurality of staggered scallop-like serrations 81 formed along its opposite sides with the cusp between adjacent serrations on one side of opening 80 being aligned substantially midway of the scalloped serration on the opposite side thereof. The scallops are such a to substantially match the radius of the reduced cylindrical stem portion 52 of the pivot pin so that portion 52 may be inserted into the elongated slot 80 with the stem portion engaging a scallop depression 81 and an opposing cusp 82 to anchor the pin from translating along opening 80. By this arrangement the vertical pivot axis for the door panel 19, for example, may be adjusted laterally by placing pin portion 52 in a selected one of the scallops 81 at a desired lateral position in opening 80. Note that pin 31 rotates with the mounting sleeve 30 and door panel 19 relative to bracket 33 as illustrated in FIGS. 3 and 5.

From the foregoing description it will be recognized that lateral alignment of the pivot axis for door panel 19 is readily achieved by placing the stem portion 52 of the pivot pin 31 in a desired scallop or semi-circular depression along one side of the elongated opening 80 in the floor engaging bracket 33 to achieve that objective of this invention. Secondly, vertical adjustment of the door panel 19 within the door opening is achieved readily by rotating the adjustment wheel 32 about the threaded shank 50 of the bottom pivot pin, as above described, whereby to translate the pivot pin relative to the door fixed mounting sleeve 30 and thus raise or lower the door relative to the floor engaging bracket 33. This vertical adjustment, of course, is readily carried out without disturbing or raising the door panels whereas lateral adjustment of the pivot axis for panels 19 or 22 requires lifting the door panels to free the lower end of the pivot pin from the floor bracket 33 so that the pin may be reinserted into the slotted opening 80 at a desired location. It will be noted that stem portion 52 of the pivot pin is sufficiently elongated to prevent accidental dislocation of that pin by its disengagement from the slotted opening 80 whereby to maintain a positive adjusted position for the door panels.

Having described this invention it is believed that those familiar with the art will readily recognize and appreciate its novel advancement over the prior art and will understand that while this invention has been described in association with a preferred embodiment thereof illustrated in the accompanying drawings, the same is nevertheless susceptible to modification, variation and substitution of equivalents without departing from the spirit and scope of the invention which is intended to be unlimited by the foregoing except as may appear in the following appended claims.

The embodiments of the invention in which an exclusive property or privilege is claimed are defined as follows:

1. In a folding door installation wherein a door panel is mounted in a framed opening for pivotal movement about a vertical axis defined by top and bottom pivots, a four piece bottom pivot assembly for undersupporting the door panel comprising:

a tubular mounting sleeve comprising means for non-rotatably anchoring the same in a socket formed inwardly of the bottom end of said panel, elongated linear guideways formed internally of said sleeve and extending longitudinally thereof, and an annular lip flange extending radially outwardly of the bottom end of said sleeve; a unitary rigid pivot pin comprising a generally cylindrical externally threaded body portion, guide means on said pin extending outwardly of said body portion for sliding engagement with said guideways whereby said pin is non-rotatably coupled to said sleeve for sliding movement therein, a stop collar formed at the lower end of said body portion to project radially outwardly thereof, and a stem portion extending coaxially beyond the lower end of said body portion and stop collar;

an adjusting wheel comprising an internally threaded central hub mounted for threaded movement over said body portion beneath said lip flange, plural manually engageable spokes radiating outwardly of said hub, and plural flexible fingers extending from the upper face of said wheel which are operable to snap over the periphery of said lip flange and loosely couple said wheel to said flange for rotation thereabout; said hub projecting axially upwardly from said upper face of said wheel to fit coaxially within a recessed socket opening axially inwardly of the bottom end of said sleeve whereby to effect rotational and thrust bearing engagement between said hub and sleeve; and a rigid pivot bracket mountable beneath the bottom end of said panel comprising a floor engaging adjustment arm having an elongated platform portion operationally elevated above the floor and extending beneath said panel; said platform portion having a central elongated opening formed with multiple serrations formed along opposing lengthwise edges thereof and arranged for receiving and holding said stem portion of said pivot pin at selected locations in said opening; said stop collar limiting insertion of said stem portion into said opening.

2. The combination of claim 1, and plural detent projections formed on the bottom face of said lip flange, said wheel having plural spaced openings in its upper face constructed and arranged to registeringly align with said detent projections in response to selected rotation of said wheel whereby to interengage said detent projections and openings and releasably hold said wheel in selected rotational positions.

3. The combination of claim 1, wherein said hub and recessed socket are formed with mating frusto-conical surfaces.

4. The combination of claim 1, and an annular shoulder formed about the lower end of said sleeve adjacent said lip flange; the upper end of said shoulder operably underengaging the bottom face of said panel whereby to position said lip flange a sufficient distance from the panel's said bottom face to permit rotational movement of said wheel about said lip flange without interfering with said panel.

* * * * *

UNITED STATES PATENT AND TRADEMARK OFFICE

CERTIFICATE OF CORRECTION

PATENT NO. : 5,054,163

DATED : October 8, 1991

INVENTOR(S) : John R. Sterling & Richard G. Kluge

It is certified that error appears in the above-identified patent and that said Letters Patent is hereby corrected as shown below:

Col. 1, line 16, delete "to" and insert "top".

Col. 2, line 14 and 15 the brackets should be removed.

Col. 3, line 50, delete "an" and insert -- and --.

Col. 7, line 48, " a unitary . . ." should begin a new paragraph.

Signed and Sealed this

Second Day of March, 1993

*Attest:*

STEPHEN G. KUNIN

*Attesting Officer*

*Acting Commissioner of Patents and Trademarks*